United States Patent [19]

Irie et al.

[11] Patent Number: 5,040,848

[45] Date of Patent: Aug. 20, 1991

[54] SEATBACK FRAME

[75] Inventors: Hideki Irie; Yoshihiko Yamauchi, both of Kanagawa, Japan

[73] Assignee: Ikeda Bussan Company Ltd., Kanagawa, Japan

[21] Appl. No.: 523,610

[22] Filed: May 15, 1990

[30] Foreign Application Priority Data

May 23, 1989 [JP] Japan ..... 1-59201

[51] Int. Cl.[5] ..... A47C 7/00

[52] U.S. Cl. ..... 297/452; 297/183; 297/460

[58] Field of Search ..... 297/452, 460, 183, 410

[56] References Cited

U.S. PATENT DOCUMENTS 3,951,454 4/1976 Tantlinger ..... 297/183 X
4,583,783 4/1986 Kanai ..... 297/452
4,715,653 12/1987 Hattori et al. ..... 297/460 X
4,883,320 11/1989 Izumida et al. ..... 297/460 X

FOREIGN PATENT DOCUMENTS 46892 3/1982 European Pat. Off. ..... 297/460
1373267 8/1964 France ..... 297/460

*Primary Examiner*—Laurie K. Cranmer
*Attorney, Agent, or Firm*—Brooks & Kushman

[57] ABSTRACT

A seatback frame is disclosed as having an inverted-U-shaped frame member including an elongated and generally horizontal upper member and an elongated side member extending generally downwardly from each extremity of the upper member. A side panel is secured to and extends generally upwardly along and forwardly from a lower portion of each side member. A lumbar supporting panel extends laterally between, and is supported by, the side panels. The lumbar supporting panel has a central portion extending generally upwardly and is secured to a central portion of the upper member.

6 Claims, 2 Drawing Sheets

SEATBACK FRAME

TECHNICAL FIELD

The present invention relates to automobile seatback frames that are formed of an inverted-U-shaped frame member having a horizontal upper member, two side members extending downwardly therefrom, and a lumbar supporting panel having side portions secured to lower portions of the side members.

BACKGROUND ART

Automobile seatback frames including lumbar supporting panels supported between side members of seatback frame members are relatively common in the art. A typical seatback includes generally horizontal upper and lower frame members and a pair of generally vertical side members, the members being connected at their ends to form a rectangularly shaped frame.

A side panel is attached to central and lower portions of each side member and extends generally forwardly therefrom. Also included is a lumbar supporting panel extending between, and being attached to, lower portions of the side panels. One or more resilient members, such as S-shaped springs, extend between, and are attached to, upper portions of the side members.

Attending the use of these conventional seatbacks are a number of problems. For example, following a frontal collision that rapidly decelerates an automobile, the head of a rear-seat passenger restrained within the vehicle by a lap belt might continue forward, due to inertia, in an arc described about the belt and strike the upper edge of the lumbar supporting panel of a front seat. Various garnishes and the like have been mounted on the seatbacks to cushion this area, but such additions increase the production cost of the seat.

Additionally, depending on the weight, shape and posture of the occupant of a conventional seat, the space between the lumbar supporting panel and the springs could be forced apart to a point where passenger comfort is compromised.

While such seatbacks function with a certain degree of efficacy, none disclose the advantages of the improved comfort of the present invention as is hereinafter more fully described.

DISCLOSURE OF INVENTION

An object of the present invention is to provide an improved seatback having a lumbar supporting member that presents no upper edge, within the confines of the seatback frame, against which a passenger might strike his or her head and thus requiring no additional, expensive garnish to cushion such an edge.

Another object of the present invention is to provide a seatback having no gaps in its vertical, central configuration to cause discomfort to passengers having any weight, shape or posture.

In realizing the aforementioned and other objects, the seatback of the present invention includes a seatback frame having an inverted-U-shaped frame member. The frame member includes an elongated and generally horizontal upper member and an elongated side member extending generally downwardly from each extremity of the upper member.

A side panel is attached to central and lower portions of each side member and extends generally forwardly therefrom. A lumbar supporting panel extends laterally between, and is supported by, a lower port ion of each side panel. The lumbar supporting panel has a central portion extending generally upwardly and is secured to a central portion of the upper member.

Since the lumbar supporting member extends between the side members and also extends to the upper member, if a passenger strikes his or her head against the rear of the seatback between the upper member and the side members, there is no upper lumbar supporting member edge to impact.

Also, since the lumbar supporting member extends between the side members and also extends to the upper member, there need be no springs such as those described as being in a conventional seatback. There would, therefore, be no gap between a top edge of a lumbar supporting panel and springs to cause passenger discomfort.

The objects, features and advantages of the invention are readily apparent from the following detailed description of the best mode for carrying out the invention when taken in connection with accompanying drawings

BRIEF DESCRIPTION OF DRAWINGS

In the drawings, in which like reference characters indicate corresponding parts in all the views.

BEST MODE FOR CARRYING OUT THE INVENTION

Figure 1:
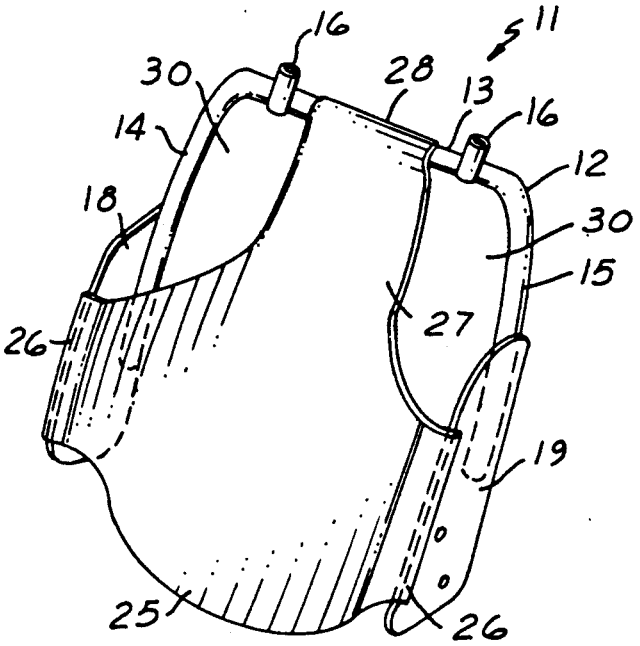
FIG. 1 is a perspective view of a preferred embodiment of the present invention.

With reference to FIG. 1 of the drawings, shown is a perspective view of the seatback frame, generally indicated by reference numeral 11. The seatback frame 11 has an inverted-U-shaped frame 12, which may be formed from tubing or the like. The frame member 12 includes an elongated and generally horizontal upper member 13 and elongated side members 14 and 15 extending generally downwardly from each extremity of the upper member 13.

Side panels 18 and 19 are secured to and extend generally upwardly along and forwardly from a lower portion of side members 14 and 15 respectively. A lumbar supporting panel 25 which is typically formed of a resilient material, extends laterally between, and is supported at lateral edges thereof by, lower portions of side panels 18 and 19. The lumbar supporting panel has an extended central portion 27 projecting generally upwardly and secured at an upper edge 28 thereof to a central portion of the upper member 13.

As shown, the side panels 18 and 19 are shaped so that the lateral edges 26 of the lumbar supporting panel 25 are positioned well forward of a plane defined by the side members 14 and 15. This permits the lumbar supporting panel 25 to have a curved configuration in the lower portion thereof to provide lateral support for a seated occupant. As the lumbar supporting panel 25 extends upwardly, it approaches the plane defined by the side members 14 and 15 and assumes a substantially flat shape dictated by the attachment of its upper edge 28 to the upper member 13

As is also shown, the lumbar supporting panel 25 is shaped so that the upper edge 28 of the extended central portion 27 does not extend along the entire length of the upper member 13; and the lateral edges 26 do not extend to the upper member 13. This results in their being a space 30 between the lumbar supporting panel 25, the upper member 13 and the side member 14 and between the lumbar supporting panel 25, the upper member 13 and the side member 15. The spaces 30 are preferably of such a size that a passenger's head is incapable of passing therethrough.

As also shown in FIG. 1 of the drawings, a pair of headrest brackets 16 are secured to the upper member 13 and symmetrically spaced about a central portion thereof. The brackets 16 are disposed to receive and hold a headrest support so that a headrest may be mounted on the seatback frame 11.

Figure 2:
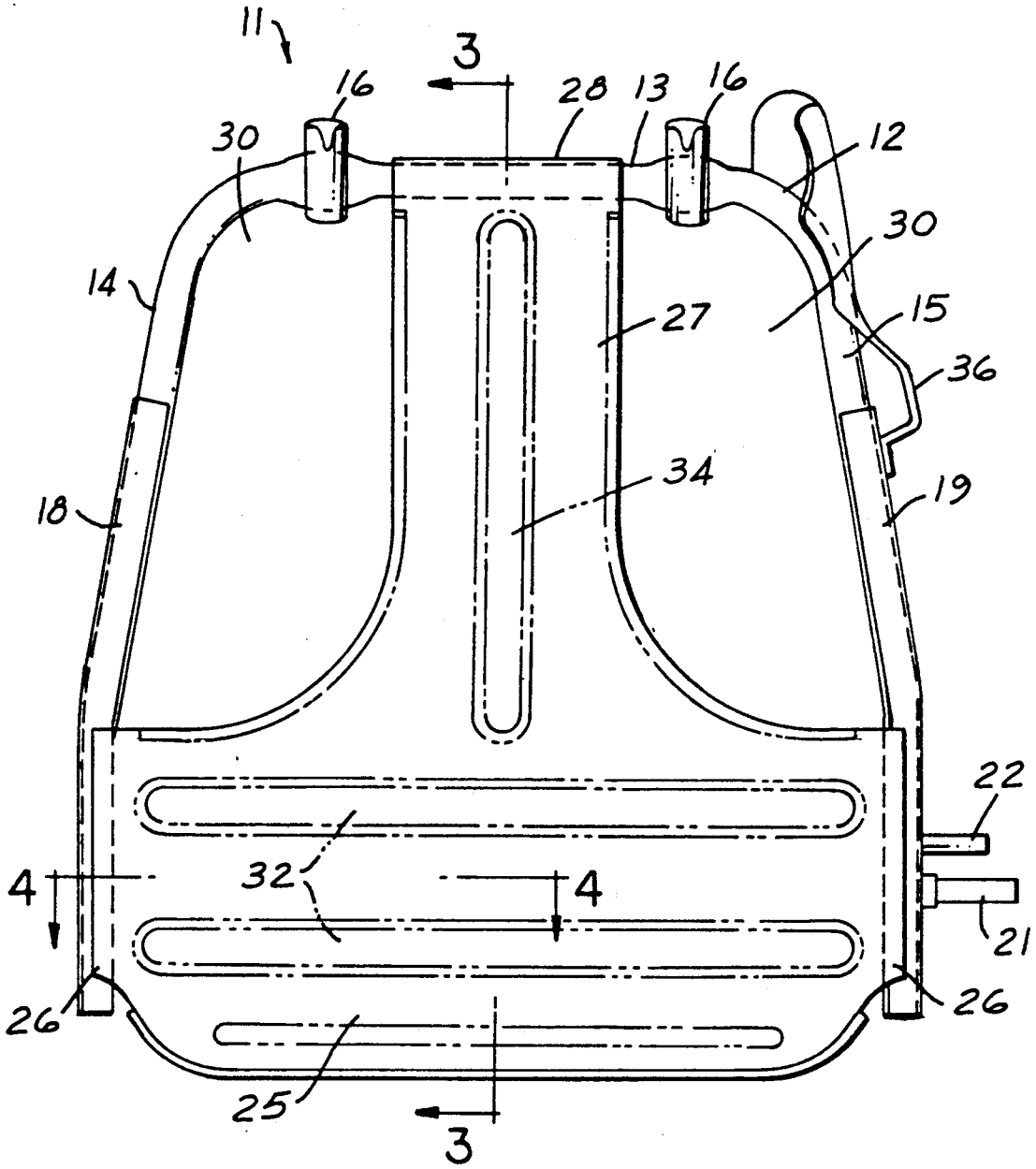
FIG. 2 is a front view of the seatback shown in FIG. 1, illustrating additional features thereof.

Shown in FIG. 2 of the drawings is a front view of the seatback frame 11 of the present invention. The elements of the seatback frame 11 shown are essentially those shown in FIG. 1, and further include a pair of upper and lower beads 32 extending horizontally across the lower portion of the lumbar supporting panel 25. A third such bead 34 extends vertically along the center of the extended central portion 27.

Shown connected to the side panel 19 is a pivot shaft 21, by which an armrest (not shown) may be mounted, and an armrest guide pin 22, by which pivotal movement of the armrest about the pivot shaft 21 may be restricted. A pivot shaft 21 and armrest guide pin 22 may also be connected to the side panel 18 in a manner similar to that shown if an armrest on each side of a seat is desired. Shown secured to the frame member 12 is a bracket 36 used to mount a passenger assist grip thereto.

Figure 3:
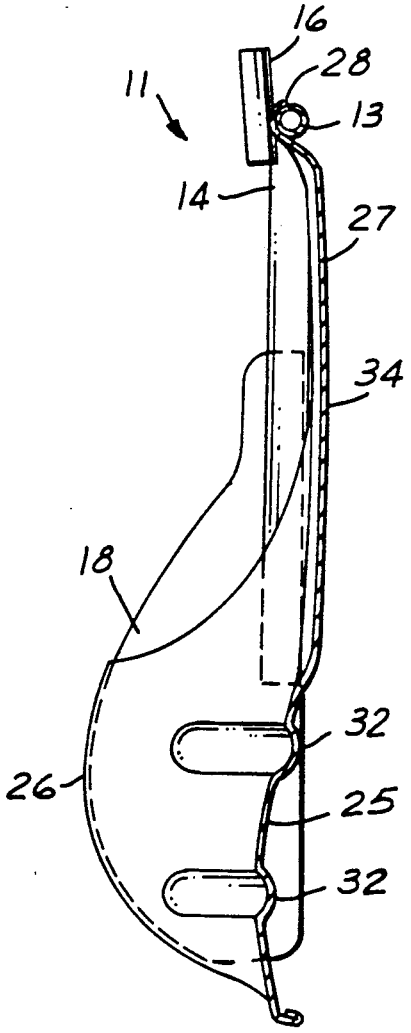
FIG. 3 is a sectional view, taken along the line 3—3, of FIG. 2.

FIG. 3 of the drawings shows a sectional view of the seatback frame 11 shown in FIG. 2. The section is taken along a central line 3—3 passing vertically therethrough.

Figure 4:
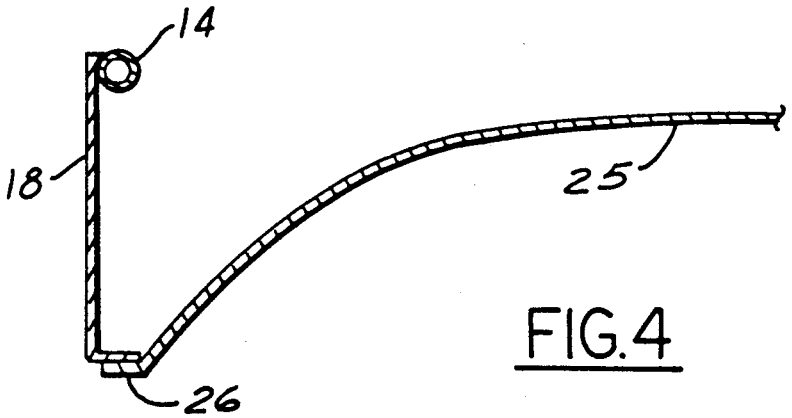
FIG. 4 is a partial, sectional view, taken along the line 4—4, of FIG. 2.

Shown in FIG. 4 of the drawings is a sectional view of a portion of the seatback frame 11 shown in FIG. 2. The section is taken along a horizontal line 4—4 passing through a lower portion of the seatback frame 11 and shows details of the side member 18, a portion of the lumbar supporting panel 25 and the connection of the lateral edge 26 of the lumbar supporting member 25 to the side panel 18. As shown, the lumbar supporting member 25 is curved by a degree corresponding to the projection of the side panel 18 so that desired occupant support is provided by all portions of the lumbar supporting member 25.

Figure 5:
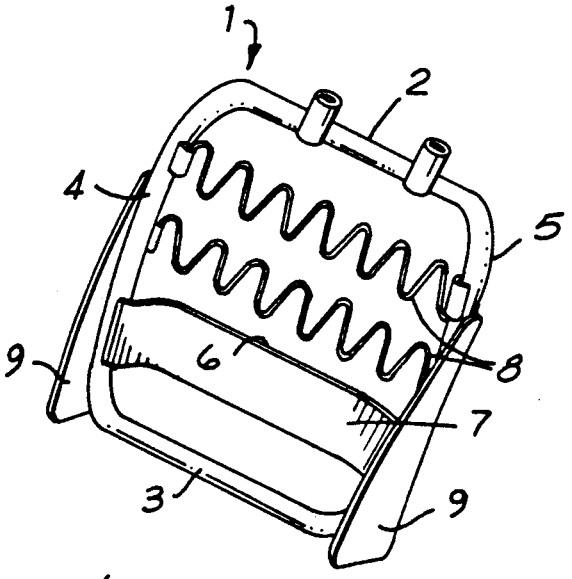
(PRIOR ART) FIG. 5
FIG. 5 is a perspective view of a conventional seatback frame.

With reference to FIG. 5, shown is a perspective view of a conventional seatback frame, generally indicated by reference numeral 1. Generally horizontal upper and lower frame members 2 and 3 respectively are connected at their ends to a pair of generally vertical side members 4 and 5 at their ends to form a rectangularly shaped frame.

A side panel 9 is attached to central and lower portions of each side member 4 and 5 and extends generally forwardly therefrom. Also included is a lumbar supporting panel 7 having an upper edge 6 and extending between, and being attached to, lower portions of the side panels 9. One or more resilient members 8, such as S-shaped springs, extend between, and are attached to, upper portions of the side members 9.

As previously mentioned, the use of these conventional seatbacks is attended by a number of problems. For example, following a frontal collision that rapidly decelerates an automobile, the head of a rear-seat passenger restrained within the vehicle by a lap belt might continue forward, due to inertia, in an arc described about the belt and strike the upper edge 6 of the lumbar supporting panel 7 of a front seat. Various garnishes and the like have been mounted on the seatbacks to cushion this area, but such additions increase the production cost of the seat.

Additionally, depending on the weight, shape and posture of the occupant of a conventional seat, the space between the lumbar supporting panel 7 and the springs 8 could be forced apart to a point where passenger comfort is compromised.

In the present invention, since the lumbar supporting member 25 extends between the side members 18 and 19 and also extends to the upper member 13, if a passenger strikes his or her head against the rear of the seatback between the upper member 13 and the side members 18 and 19, there is no upper lumbar supporting member edge (6 in FIG. 5) to impact.

Also, since the lumbar supporting member 25 extends between the side members 14 and 15 and also extends to the upper member 13, there need be no springs (8 in FIG. 5) such as those described as being in a conventional seatback shown in FIG. 5. There would, therefore, be no gap between a top edge 6 of a lumbar supporting panel 7 and springs 8 to cause passenger discomfort.

While the best mode for carrying out the invention has been described in detail, those familiar with the art to which this invention relates will recognize various alternative designs and embodiments for practicing the invention as disclosed by the following claims.

What is claimed is:

1. A seatback frame comprising:

an inverted-U-shaped frame member including an elongated and generally horizontal upper member and an elongated side member extending generally downwardly from each extremity of the upper member; and a lumbar supporting panel extending laterally between and being secured to a lower portion of each side member, the lumbar supporting panel having a central portion extending generally upwardly and being secured to a central portion of the upper member.

2. A seatback frame comprising:

an inverted-U-shaped frame member including an elongated and generally horizontal upper member and an elongated side member extending generally downwardly from each extremity of the upper member;

a side panel secured to and extending generally upwardly along and forwardly from a lower portion of each side member; and a lumbar supporting panel extending laterally between and being secured to each side panel, the lumbar supporting panel having a central portion extending generally upwardly and being secured to a central portion of the upper member, the lumbar supporting panel being forwardly spaced from the side members by the side plates.

3. The seatback frame as defined by claim 1 or 2, wherein the U-shaped frame member comprises a single piece of tubing.

4. The seatback frame as defined by claim 3, wherein the lumbar supporting panel comprises a resilient material.

5. The seatback frame as defined by claim 3, further including at least one headrest bracket secured to the upper member to receive and hold a headrest support.

6. The seatback frame as defined by claim 3, further including a grip bracket secured to the frame member to mount a passenger assist grip thereto.

* * * * *